US006219856B1

(12) United States Patent
Alles

(10) Patent No.: US 6,219,856 B1
(45) Date of Patent: Apr. 24, 2001

(54) FLOW RESTRICTOR FOR WATER CLOSET REFILL TUBE

(76) Inventor: Wilmer F. Alles, 173 E. Belmar Ave., Absecon, NJ (US) 08201-9758

( * ) Notice: Subject to any disclaimer, the term of this patent is extended or adjusted under 35 U.S.C. 154(b) by 0 days.

(21) Appl. No.: 08/230,075

(22) Filed: Apr. 20, 1994

(51) Int. Cl.[7] ..... E03D 1/00

(52) U.S. Cl. ..... 4/415; 137/441

(58) Field of Search ..... 4/415, 222, 225.1, 4/226.1; 138/44, 40; 137/441; 285/239

(56) References Cited

U.S. PATENT DOCUMENTS

| | | | | |
|---|---|---|---|---|
| 216,736 | * | 6/1879 | Hall, II | 285/239 |
| 585,014 | * | 6/1897 | Wenzel et al. | 285/239 |
| 928,237 | * | 7/1909 | Baird | 285/239 |
| 1,078,584 | * | 11/1913 | Jones | 138/46 |
| 1,137,382 | * | 4/1915 | Calvert | 285/239 |
| 1,671,361 | * | 5/1928 | Frankenberger | 137/441 |
| 1,901,633 | * | 3/1933 | Clemmons | 137/436 |
| 1,939,509 | * | 12/1933 | McClelland | 138/44 |
| 2,401,665 | * | 6/1946 | Schick | 138/44 |
| 2,722,944 | * | 11/1955 | Langdou et al. | 137/441 |
| 2,804,928 | * | 9/1957 | Farrar | 138/40 |
| 3,086,546 | * | 4/1963 | Brown | 137/441 |
| 3,311,131 | * | 3/1967 | Zahuranec | 138/44 |
| 3,656,783 | * | 4/1972 | Reeder | 285/239 |
| 3,744,064 | * | 7/1973 | Preston | 4/325 |
| 4,105,721 | * | 8/1978 | Schliebe | 138/44 |
| 4,145,775 | | 3/1979 | Butler | 4/415 |
| 4,538,307 | | 9/1985 | Barnum | 4/427 |
| 4,764,996 | | 8/1988 | Pino | 4/415 |
| 4,915,135 | * | 4/1990 | Kellenbarger et al. | 138/44 |
| 4,980,932 | | 1/1991 | Stemples | 4/415 |
| 5,004,462 | | 4/1991 | Mahler | 4/325 |
| 5,058,216 | | 10/1991 | Trayer et al. | 4/251 |
| 5,134,729 | | 8/1992 | Shaw | 4/415 |
| 5,259,074 | | 11/1993 | Battle | 4/325 |

* cited by examiner

*Primary Examiner*—Charles R. Eloshway

(57) ABSTRACT

An externally threaded thermoplastic flow restriction member is threaded into the internal bore of a toilet bowl thermoplastic refill tube in interference fit with the tube bore. The restriction member has a bore which is sized to restrict the flow of toilet bowl refill water during tank refill so the bowl is filled in about the same period of time as the tank. A slot can be formed in one end of the restriction member to permit the restriction member to be inserted readily into the refill tube.

1 Claim, 1 Drawing Sheet

FIG. 1
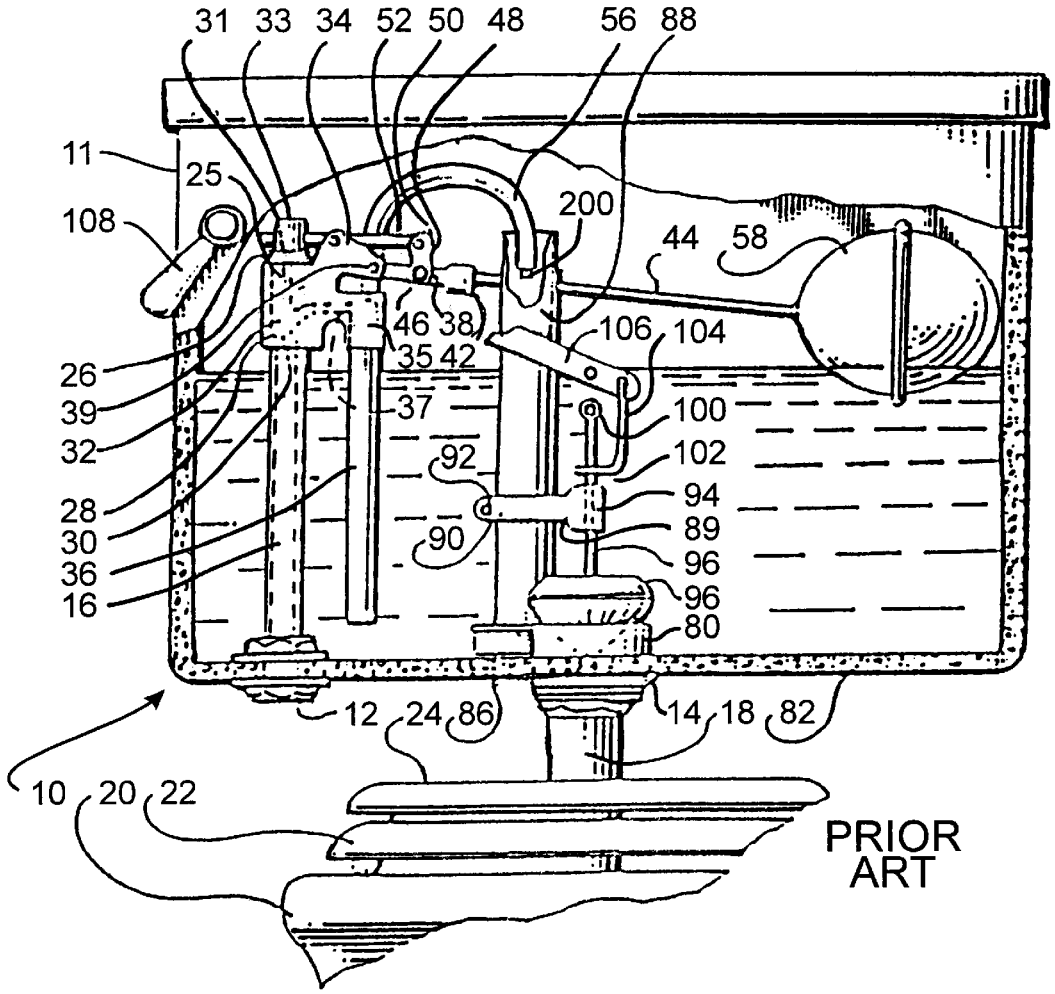
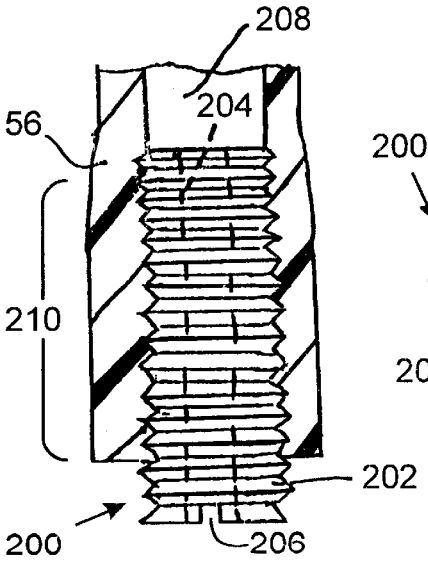
FIG. 4
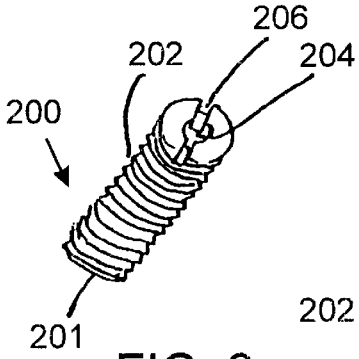
FIG. 2
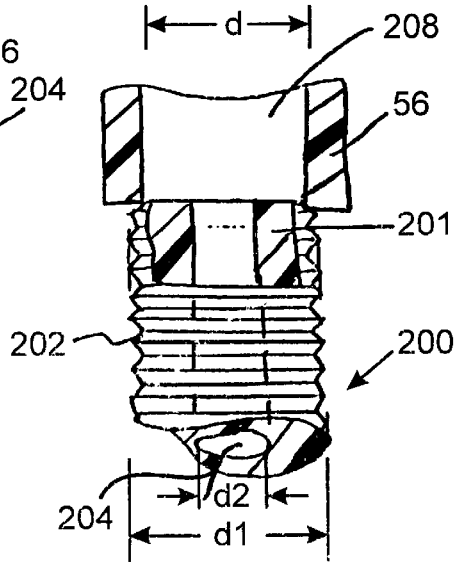
FIG. 3

FLOW RESTRICTOR FOR WATER CLOSET REFILL TUBE

This invention relates to water flow restrictors to reduce water wastage during bowl refill of water closets.

In conventional water closets comprising a bowl and a tank which receives flush water for selectively discharging to the bowl, the bowl is simultaneously refilled with water as the tank is refilled. Since the tank is much larger than the bowl and typically fills at a significantly slower rate, once the bowl fills, added refill water supplied thereto discharges into the water closet discharge plumbing, wasting the water thereafter supplied to the bowl as the tank continues to fill. Since in the United States, at least, the sole water supplies to a community is potable, treated, water, this waste of the excess water, while not considerable for each flush, when multiplied by millions of people, for up to 6–8 flushes per day, amounts to a considerable drain on increasingly precious potable water resources. Chemicals used to treat potable water supplies are discharged to the groundwater, further contaminating natural water supplies. This wastage of significant amounts of potable water thus is expensive both in terms of cost and of harm to the environment.

The prior art recognizes this problem, and several solutions have been offered heretofore. For example, U.S. Pat. No. 4,764,996 to Pino provides a pinch clamp for restricting flow through the bowl's flexible refill tube, and a threaded metal fitting is attached to the tube for securing an S-shaped wire to secure the refill tube end to the rim of an overflow pipe. However, pinch tubes may not accurately control the water flow rate.

U.S. Pat. No. 5,134,729 to Shaw uses a plurality of flow control inserts which are retained in the refill tube by frictional engagement in the refill tube. These may have the problem that water pressure in the tube may force the inserts out of the refill tube.

U.S. Pat. No. 5,058,216 to Trayer et al discloses a variable flow control restrictor, and U.S. Pat. No. 4,145,775 to Butler discloses a two piece hollow assembly whose pieces are rotatable relative to each other to vary the flow rate therethrough. Another adjustable valve device is disclosed in U.S. Pat. No. 4,980,932 to Stemples. However, adjustable devices are relatively costly and may be difficult for the average homeowner to install. Other water closets having adjustable water filling devices are illustrated in U.S. Pat. No. 5,259,074 to Battle, U.S. Pat. No. 4,538,307 to Barnum et al and U.S. Pat. No. 5,004,462 to Mahler.

There is still a need for a simple, low cost restrictor that can be readily installed by a layman and that reduces the amount of water wasted for each flush of a water closet.

SUMMARY OF THE INVENTION

A conventional water closet includes a toilet bowl, a toilet tank for supplying flush water to the bowl, water supply means for supplying water to fill the tank and bowl refill means including a thermoplastic, flexible tube having a first bore of a given internal diameter. The water supply means supplies fill water to the bowl simultaneously with fill water to the tank, but the bowl fills more rapidly than the tank, and overflows to a water closet discharge. The present improvement comprises, in accordance with one embodiment of the present invention, a restriction member having external threads along its outer periphery and having a second bore smaller than the first bore for insertion into the first bore, thereby restricting the bowl refill rate, and limiting the amount of excess water that overflows into the water closet discharge. The external threads have a tooth crest outer diameter greater than the first bore internal diameter, thereby providing threaded interference engagement between the restriction member having external threads and the refill tube first bore.

In accordance with a further embodiment of the present invention, tool receiving means are formed in the tubular restriction member at one end to permit attachment of the external threaded restriction member to the thermoplastic refill tube at a tube end. In a further embodiment, the tool receiving means is a slot for a screw driver tool.

BRIEF DESCRIPTION OF THE DRAWING

FIG. 1 is a fragmented side elevational view partially in section, of a water closet according to one embodiment of the present invention.

FIG. 2 is an isometric view of a refill tube flow restriction member having external threads used in the embodiment of FIG. 1.

FIG. 3 is an elevational sectional fragmented view of the restriction member of FIG. 2 about to be inserted into the bowl refill tube, showing the relation of the various bore diameters.

FIG. 4 is a sectional partial elevational view of the e nd of the bowl refill tube with the restriction member of the present invention inserted therein.

DETAILED DESCRIPTION OF THE INVENTION

Referring now to FIG. 1, a water closet 10 has a flush water receiving tank 11, the closet being conventional and as described in the aforementioned U.S. Pat. No. 4,764,996 and 4,145,775, incorporated herein by reference. The tank 11 has a water inlet 12 and a water outlet 14. A conduit 16 is connected to a source (not shown) of pressurized water at inlet 12. A discharge pipe 18 is connected at its upper end to outlet 14 and at its bottom end to a conventional bowl 20 having a seat 22 and a cover 24.

An intake valve 25 is mounted on the top of the intake conduit 16, and includes a valve casing 26 with a vertical bore 28 and a valve seat 30 at the bore bottom. A valve stem 31 has a ball valve 32 connected thereto seated against the seat 30. The stem 31 has an end opposite to the valve 30 connected to a sliding piston 33 in the bore 28.

The valve casing 26 has an arm 34 extending into the tank 11 and has a downwardly extending opening water outlet 35 connected to the bore 28 by a bypass 37 and closet tank filling tube 36. A lever 38 is pivoted to the pin 39, the other end of the lever having a socket 42. A float rod 44 end is secured to the socket 42. A ball float 58 is connected to the rod 44 at its other end. A link 48 is pivoted at pivot 46 to the lever 38 at one link end, and at the other link end to a lever 52 at the pivot 50. The lever 52 is pivoted midway between its ends to the arm 34 and at its other end to the piston 33 to open the intake valve 25 in one direction, and close it in the other direction. The piston 33 controls the flow of water through the intake valve 25. A refill tube 56 is coupled to the top of the water outlet 35 at one end to an already installed fitting, and the other end of the refill tube 56 extends into the overflow pipe 88. The refill tube 56, already an existing part of the water closet mechanism, is made suitably of a thermoplastic which is pliable and flexible. The refill tube 56 has a threaded fitting at one end for attachment to the outlet 35.

In the prior art, the discharge end of the refill tube 56 normally is suspended in the upper end of the overflow pipe 88 by an S-shaped hook. In such water closets requiring an S-shaped hook to retain the refill tube 56 in the overflow pipe 88, it would still be required in the present invention, as further explained hereinbelow, so that the refill tube 56 is not displaced from the overflow pipe. When the S-shaped hook is suspended in the refill tube 56, it is placed such that only a small portion of the refill tube extends into the overflow pipe 88. The refill tube 56 fills the bowl 20 simultaneously when the tank 11 is filled via fill pipe 36. As the tank 11 fills, water flows through the refill tube 56 into the overflow pipe 88 into the bowl 20, filling the bowl 20. Unless otherwise provided for, the bowl 20 fills much quicker in most water closets than the tank 11.

A water flow restriction member 200, in accordance with the present invention, is inserted into the end of the refill tube 56 which extends inside the overflow pipe 88. The restriction member 200 restricts the flow of water to the bowl 20 so that the bowl 20 fills more slowly in order to match the filling rate of the tank 11. In FIG. 2, the restriction member 200 has a circular cylindrical body 201 which is preferably made of a rigid thermoplastic, e.g., nylon, and has external threads 202. The body 201 has an axially extending central circular cylindrical bore 204 in communication with both ends of the body 201. A screw driver receiving slot 206 is formed in one end of the body 201.

When an S-shaped hook is employed, referred to hereinabove, the restrictor 200 is screwed into the refill tube far enough, approximately ¾ of an inch, to permit the S-shaped hook to be inserted in the end of the refill tube 56.

In water closets having a retaining device already installed in the top of the overflow pipe 88, the restrictor 200 is screwed into the end of the refill tube 56, when the refill tube 56 is reinserted into the installed retainer.

In FIG. 3, the refill tube 56 has a bore 208. This bore 208 has a diameter d. The external threads 202 of the restriction member 200 have a thread crest outer diameter d1. The diameter d1 is greater than diameter d. This results in an interference fit of the threads 202 in the bore 208 of the refill tube 56 wherein the threads bite into the yielding soft plastic material of the refill tube 56 as the restriction member 200 is inserted, as by a twisting motion. The bore 204 has a diameter d2 sized such that water flowing through the bore 204 will just fill the bowl 20 when the tank 11 is also just filled during the refill cycle.

To insert the restriction member 200 into the refill tube 56, a tool, such as a screw driver (not shown) may be utilized to drive the restriction member 200 into the bore 208 of the refill tube 56. Because of the interference fit, the refill tube 56 outer diameter may bulge somewhat at region 210, see FIG. 4. This interference fit provides a relatively high engagement friction load between the restriction member 200 and the refill tube 56. The plastic of the refill tube 56, being relatively soft, deforms so that its material conforms somewhat to the shape of the threads 202, as shown in FIG. 4. The plastic material of the refill tube 56 inner wall need not identically conform to the exact shape of the threads 202, as long as the restriction member 200 is forcibly retained within the refill tube 56 bore 208. Also, water pressure in the refill tube 56 can not disengage restriction member 200 because of the threaded engagement and because of the frictional forces as well.

The screw driver slot 206 is not critical, as other means may be employed to insert the restriction member 200 into the refill tube 56. Such means can include a temporary nut attached to the restriction member 200. This nut can later be removed from the restriction member 200 if desired. However, the screw driver slot 206 is preferred because of the simplicity of insertion of the restriction member 200 into the bore 208, and the ease of removal of the restriction member 200 from the refill tube 56 if required. Also, high turning insertion forces can be provided to the restriction member 200 by using a tool such as a screw driver. The insertion forces can be set by setting the desired thread diameter of the restriction member 200 by using different diameter threads 202. The amount of interference plainly will set the insertion load. This interference load also depends upon the type of plastic material used for the refill tube 56, which is supplied with the water closet 10.

Preferably, the bore 204 of restrictive member 200 has a diameter such that the bowl can fill without excessive overflow, and can vary somewhat, suitably in the range of about 1/16 to about 5/32 inch for most water closets. This range may differ in accordance with a particular water closet tank fill rate and water pressure. For conventional water closets, the restriction member 200 internal bore diameter may be at least 5/64 inch, and preferably is about 3/32 inch, to maintain a proper flush for the bowl 20. Newer water closets of reduced capacity, e.g., 1.6 gallon of water capacity, will require a restriction member 200 diameter of about 9/64 inch.

The restriction member 200 preferably is formed from conventional threaded nylon screw stock of ¼ 20 threads and has an axial length of about ½ inch. Because refill tubes 56 of newer 1.6 gallon water closets are smaller than older models, the restriction member 200 may be formed of 12/24 screw stock. These examples are illustrative only, and the outer diameter of the restriction member 200 is not critical, except that it must be larger than the bore 208 of the refill tube 56.

While a screw driver is described as suitable for driving the restriction member 200 into the bore 208 of the refill tube 56, other embodiments may be used, e.g., the restriction member 200 may be formed with flattened sides to receive a wrench for insertion of the restriction member 200 into the refill tube 56. The restriction member 200 is preferably made of thermoplastic, but may also be made of metal if desired. However, thermoplastic is less expensive and is not subject to corrosion, and thus is preferred.

The remaining structure of the water closet 10 of FIG. 1 is conventional. As a result of the present invention, a simple, low cost, reliable water flow restriction member is provided which is simple to install and that is adaptable to different size bowl refill tubes 56.

Various modifications may be made to the above-described embodiments of the restriction member, as will be known to one skilled in the art. The embodiments shown and described hereinabove are illustrative only and are not meant to limit the scope of the invention, which is meant to be limited only by the appended claims.

I claim:

1. In a water closet including a toilet bowl, a toilet tank for supplying flush water to the bowl, water supply means for supplying water to fill said tank and bowl refill means, including a thermoplastic pliable, flexible tube having a first bore of a given internal diameter, said tube receiving water from said supply means for supplying fill water to said bowl simultaneously with the filling of said tank, wherein said bowl fills more rapidly than said tank, the improvement which comprises a rigid thermoplastic restriction member inserted into an end of said flexible tube with external threads along its outer periphery having a second bore smaller than the first bore, said external threads having a tooth crest outer diameter greater than the first bore internal diameter for threaded interference engagement of the restriction member in the first bore, said second bore having a diameter such that the bowl refills in about the same period of time as the tank, to thereby preclude the bowl from filling faster than the tank; and tool receiving means formed in said restriction member at one end to permit inserting the restriction member in said thermoplastic tube at a tube end.

* * * * *